United States Patent [19]

Hait

[11] Patent Number: 4,915,090

[45] Date of Patent: Apr. 10, 1990

[54] RELECTOR STOVE

[75] Inventor: Paul W. Hait, Los Gatos, Calif.

[73] Assignee: Pyromid, Inc., Redmond, Oreg.

[21] Appl. No.: 465,311

[22] Filed: Feb. 9, 1983

[51] Int. Cl.[4] ..... F24C 1/16

[52] U.S. Cl. ..... 126/9 R; 126/29

[58] Field of Search ..... 126/9 R, 9 B, 38, 25 R, 126/29

[56] References Cited

U.S. PATENT DOCUMENTS

| | | | |
|---|---|---|---|
| 1,102,649 | 7/1914 | Dix | 126/9 |
| 1,247,806 | 11/1917 | Ferdon | 126/9 R |
| 1,357,697 | 11/1920 | Adams . | |
| 1,396,059 | 11/1921 | Reppetto | 126/9 B |
| 1,403,842 | 1/1922 | Chambers et al. . | |
| 1,438,345 | 12/1922 | Tait et al. | 126/9 R |
| 2,988,082 | 6/1961 | Kuhn . | |
| 3,103,160 | 9/1963 | Forniti | 126/38 |
| 3,489,131 | 1/1970 | Richins | 126/9 |
| 3,809,051 | 5/1974 | Giroux | 126/9 R |
| 4,140,099 | 2/1979 | Newport | 126/9 A |
| 4,204,516 | 5/1980 | Figura | 126/9 R |

*Primary Examiner*—Kenneth J. Dorner
*Assistant Examiner*—Gerald Anderson
*Attorney, Agent, or Firm*—Jack M. Wiseman

[57] ABSTRACT

A stove comprising a housing having a grill-covered top opening and one open side and means defining a combustion area internally of the housing below the grill.

7 Claims, 1 Drawing Sheet

Fig. 1
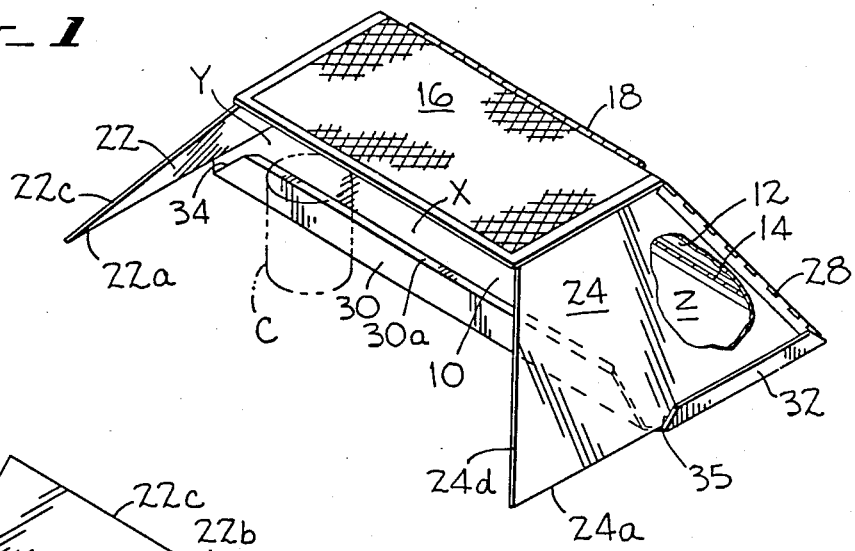
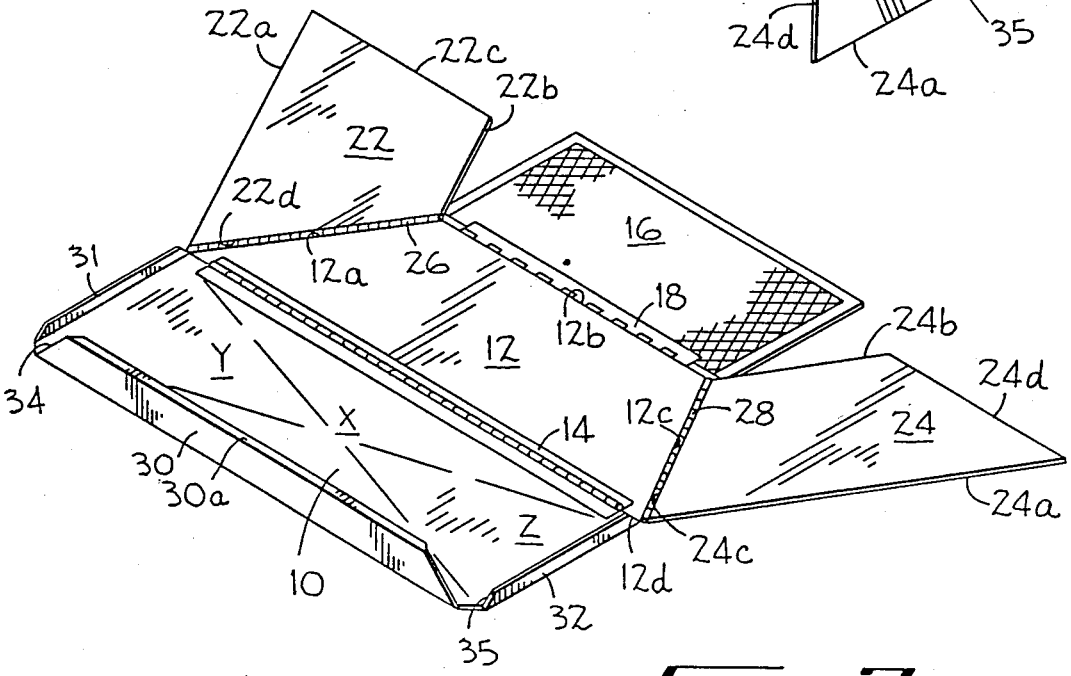
Fig. 2
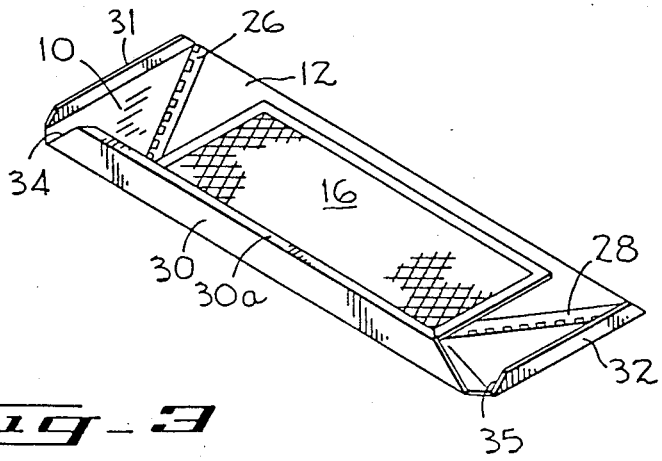
Fig. 3

RELECTOR STOVE

BACKGROUND OF THE INVENTION

Various types of stoves have been proposed for outdoor cooking and some of these have been units that can be folded into collapsed form to provide a relatively small package that can be easily transported from place to place. Such units are disclosed in my copending applications Ser. No. 296,879 now abandon, Ser. No. 378,111 now U.S. Pat. No. 4,489,706 and Ser. No. 440,984 now U.S. Pat. No. 4,508,094, and each of these stoves have certain desirable features. The stove of the present invention provides a structure that can be folded to a compact collapsed, easily portable form, or can be erected to form a stove that provides a maximum of cooking and food warming space in a sheltered enclosure.

SUMMARY OF THE INVENTION

A stove has a collapsible housing open on one side to provide access to the combustion zone and enclosed areas adjacent the zone and includes a grill positioned above the combustion zone.

DESCRIPTION OF THE DRAWINGS

FIG. 1 is a perspective of the stove of the present invention in erected position.

FIG. 2 is a diagrammatic perspective of the stove in a collapsed, general flat position.

FIG. 3 is a diagrammatic perspective of the stove in a collapsed, folded position adapting it for ease of transporting.

DESCRIPTION OF A PREFERRED EMBODIMENT

The stove of the present invention comprises a base panel 10, a rear wall panel 12 connected at one edge by a piano hinge 14 to panel 10, a grill 16 pivotally connected by a hinge 18 to the opposite edge of the panel 12, and side plates 22 and 24 that are connected by hinges 26 and 28, respectively, to opposite side edges of the rear panel 12. The base 10 has an upstanding flange 30 on its edge opposite the edge to which the hinge 14 is connected, and flanges 31 and 32 projecting upwardly from its two side edges respectively. A corner notch 34 is formed between flanges 30 and 31, and a similar notch 35 is formed between flanges 30 and 32.

The base panel 10 is a rectangular plate that is generally planar but is indented upwardly from the edges to the central point 10*a* that provides a high central point away from which grease or the like will drain downwardly and outwardly. The flange 30 on one edge of panel 10 has an inturned flange 30*a* at its upper edge. The grill 16 is a rectangular planar member made of expanded metal and having a solid metal band extending entirely around its outer edges. The rear panel 12 is a flat plate that is trapezoidal in configuration, having parallel side edges 12*b* and 12*d*, and slanted side edges 12*a* and 12*c* that are of equal length. Side panel 22 is also a flat plate that is trapezoidal in configuration, having parallel side edges 22*a* and 22*b*, and slanted side edges 22*c* and 22*d* that are equal in length. Side panel 24 is identical to panel 22 in size and configuration and has parallel side edges 24*a* and 24*b* and slanted edges 24*c* and 24*d* of equal length. All of the panels 10, 12, 16, 22 and 24 are made of stainless steel.

FIG. 2 illustrates the stove in a flattened, unfolded condition. Starting from this unfolded position, the stove is erected by pivoting panel 12, and the panels 22, 16 and 24 connected thereto, upwardly in a counterclockwise direction FIG. 2 relative to base panel 10. During this upward movement, side panels 22 and 24 are swung inwardly toward each other so that, the edges 22*a* and 24*a* will be inwardly of a position in parallel, vertical alignment with flanges 31 and 32 respectively. In this connection it should be noted that the edge 12*d* of panel 12 is a little shorter than the adjacent edge of the base 10 so that, as the pivoting movement of panels 12, 22, 24 and 16 is continued, the edges 22*a* and 24*a* will be disposed just inwardly of the side flanges 31 and 32, respectively, of the base 10 and come to rest on the base 10 inwardly of the flanges as shown in FIG. 1. The grill 16 is then pivoted to a position where its side edges rest on the upper edges 22*b* and 24*b* of the side plates. The dimensions of the panels are such that, in the erected position of FIG. 1, the grill 16 overlies the base panel 10, and the side panels 22 and 24 extend a considerable distance outwardly from the flange 30 of the base panel to provide a wind-break for cans C (FIG. 1) that might be positioned alongside the flange next to a fire built on the base panel 10. In one embodiment base panel 10 is eighteen inches long and six and a half inches wide. Rear panel 12 has an edge 12*d* that is seventeen and a half inches long; an edge 12*b* that is ten and a half inches long, and edges 12*a* and 12*d* that are each seven and one-eighth inches long. Grill 16 is eleven and one-quarter inches long and five and three-quarter inches wide. Side edges 22*c* and 22*d* and side edges 24*c* and 24*d* are each seven inches long. Edges 22*b* and 24*b* are each five and one-eighth inches long while edges 22*a* and 24*a* are each twelve and one-quarter inches long.

When the stove is in the erected position of FIG. 1, it can be bodily oriented so that a fire that will be built on base panel 10 will be best protected from the wind. After the stove is so oriented, the grill 16 can be folded back to gain better access to the base panel 10 for building a fire. When the fire is built, the grill is pivoted back to the FIG. 1 position and items of food can now be cooked on the grill. Since one side of the stove is completely open, combustion air can enter through the open side, pass through the burning fire and pass out through the grill in the form of hot gases. While items on the grill are being heated by the hot combustion gases, heat is radiated outwardly from the fire to warm cans C or the like positioned alongside flange 30. If the fire is built centrally on the base panel 10, as at the area indicated by reference letter X (FIG. 2), items such as potatoes can be placed at side areas Y and Z. Since these side areas are enclosed by side and back walls and the grill, they provided oven-like spaces in which items can be cooked.

When the stove is to be collapsed, the grill 16 is pivoted clockwise (FIG. 1) and moved to a position against the outer face of rear panel 12. Back panel 12 is then pivoted clockwise a short distance and the side panels 22 and 24 are swung inwardly so that one of them lies against the front face of the panel 12. When the side panels are disposed one against the other under the rear wall panel 12, the side panels along with the rear panel 12 and the grill 16, is swung counterclockwise (FIG. 3) down toward the base panel 10. During the end of this downward movement, the hinge 18 engages the inturned flange 30*a*, forces it back, and moves past the flange. The flange then swings back to overlie the hinge and lock the several panels relative to the base panel 10.

From the foregoing description it will be apparent that in use the stove of the present invention has a unique air flow pattern due to the open side of the housing and that the inner walls of the stainless steel housing radiate heat inwardly toward oven spaces provided internally of the housing along the side walls.

I claim:

1. A collapsible stove comprising a base panel, a rear wall panel of trapezoidal configuration pivoted at one parallel side to an edge of said base panel, a side panel of trapezoidal configuration pivotally connected to each of the non-parallel sides of said rear wall panel, and a grill panel pivoted to the other parallel side of said rear wall panel, said grill panel being pivotally connected to the upper edge of said rear wall panel and adapted to seat on the upper edges of said side panels when pivotally extended to form a stove.

2. The stove of claim 1 further comprising an inturned flange on said base panel at the edge spaced from the edge connected to said rear wall panel, a hinge on said connected edge for connecting said base panel and said rear wall panel, said side panels and said grill being foldable against said rear wall panel to form a collapsed unit, and said unit being foldable down onto said base panel, said inturned flange being disposed in the path of said hinge as said unit is moved downwardly toward said base panel, and being adapted to flex out of said path and then return to its initial position to lock said unit on said base panel.

3. A collapsible stove comprising:

(a) a rear wall panel of trapezoidal configuration having an upper side edge, a lower side edge, a first end edge and a second end edge;

(b) a base panel pivotally connected to said rear wall panel at the lower side edge of said rear wall panel;

(c) a first side panel of trapezoidal configuration pivotally connected to said rear wall panel at the first end edge of said rear wall panel;

(d) a second side panel of trapezoidal configuration pivotally connected to said rear wall panel at the second end edge of said rear wall panel; and (e) a grill panel pivotally connected to said rear wall panel at the upper side edge of said rear wall panel, said grill panel being adapted to seat on the upper edges of said side panels when pivotally extended to form a stove.

4. A stove as claimed in claim 3 wherein said base panel comprises a first side edge disposed adjacent the pivotal connection between said base panel and said rear wall panel, and wherein said base panel comprises a second side edge spaced from said first side edge, and wherein said base panel is formed with an inturned flange along said second side edge, said side panels and said grill being foldable against said rear wall panel to form a collapsed unit, said unit being foldable down onto said base panel, said inturned flange being disposed in the path of the pivotal connection between said grill and said rear wall panel as said unit is moved downwardly toward said base panel, said flange being adapted to flex out of said path and then return to its initial position to lock said unit on said base panel.

5. A stove as claimed in claim 3 wherein said base panel includes a first and second end edge and wherein said first side panel and said second side panel respectively include a first bottom edge and a second bottom edge, said first bottom edge of said first side panel and said second bottom edge of said second side panel respectively extend a greater distance from said lower edge of said rear wall panel than either said first end edge of said base panel or said second end edge of said base panel.

6. A stove as claimed in claim 3 wherein said rear panel and said side panels are made of stainless steel to provide reflective surfaces.

7. A stove as claimed in claim 5 and comprising an upstanding flange disposed along said first end edge of said base panel and along said second end edge of said base panel, said upstanding flanges providing an abutment, respectively, for said bottom edges of said first and second side panels, said first and second side panels being directed upwardly from said base panel.

* * * * *